US009241586B1

(12) United States Patent
Brown

(10) Patent No.: US 9,241,586 B1
(45) Date of Patent: Jan. 26, 2016

(54) NECK SUPPORT DEVICE

(71) Applicant: Kelley Brown, Austin, TX (US)

(72) Inventor: Kelley Brown, Austin, TX (US)

( * ) Notice: Subject to any disclaimer, the term of this patent is extended or adjusted under 35 U.S.C. 154(b) by 0 days.

(21) Appl. No.: 14/318,592

(22) Filed: Jun. 28, 2014

Related U.S. Application Data

(63) Continuation of application No. 13/745,720, filed on Jan. 18, 2013, now Pat. No. 8,769,744.

(60) Provisional application No. 61/588,032, filed on Jan. 18, 2012.

(51) Int. Cl.
*A47C 20/02* (2006.01)
*A47G 9/10* (2006.01)

(52) U.S. Cl.
CPC ..... *A47G 9/1081* (2013.01)

(58) Field of Classification Search
CPC ..... A47C 20/02
USPC ..... 5/636, 630, 640, 642, 722
See application file for complete search history.

(56) References Cited

U.S. PATENT DOCUMENTS 3,258,790 A * 7/1966 Maru ..... 5/636
4,285,081 A * 8/1981 Price ..... 5/637
5,467,490 A * 11/1995 Rice ..... 5/636

* cited by examiner

*Primary Examiner* — Fredrick Conley
(74) *Attorney, Agent, or Firm* — Law Offices of Mark L. Berrier

(57) ABSTRACT

Systems and methods for providing support to the head and/or neck, wherein the support may provide tension and desired orientation of the head and/or neck. In one embodiment, a cushioned saddle-shaped neck support is positioned at an upper end of a moveable support structure. A lower part of the saddle-shaped neck support is movably connected to an upper part of the support structure. A lower part of the support structure is movably supported by a surface on which a person's body can be positioned. The person's body is positioned on this surface with his neck over the neck support. As the person's neck comes into contact with the neck support, the weight of the person's head and/or neck pushes down on the neck support, which moves down and away from the person's shoulders to provide the desired tension and orientation.

6 Claims, 2 Drawing Sheets

NECK SUPPORT DEVICE

CROSS-REFERENCE TO RELATED APPLICATIONS

This application is a continuation of U.S. patent application Ser. No. 13/745,720, filed Jan. 18, 2013 by Kelley Brown (issued as U.S. Pat. No. 8,769,744), which claims the benefit of U.S. Provisional Patent Application 61/588,032, filed Jan. 18, 2012 by Kelley Brown, both of which are incorporated by reference as if set forth herein in their entirety.

BACKGROUND

There are many instances in which a person's head and neck are required to be supported for various medical and therapeutic purposes. For example, when a person suffers injuries to his or her head, neck or back, it may be necessary or desirable to place that person on a stretcher or gurney in order to facilitate treatment or transport of the person. It may further be necessary or desirable to ensure that the person's head and neck are properly positioned and supported on the stretcher or gurney so that his or her airway is clear. In another example, a person who is experiencing non-traumatic neck pain may find relief when his or her head and neck are properly positioned and supported when resting or undergoing therapeutic treatment.

SUMMARY OF THE INVENTION

The present invention includes systems and methods for providing support to the head and/or neck, wherein the support means facilitates a desired orientation of the head and/or neck, and in some embodiments provides tension on the head and/or neck.

In one embodiment, a saddle-shaped neck support is positioned at an upper end of a moveable support structure. An upper part of the saddle-shaped neck support is cushioned so that a person's neck can be comfortably supported thereby. A lower part of the saddle-shaped neck support is movably connected to an upper part of the support structure. A lower part of the support structure is movably supported by a surface on which a person's body can be positioned.

The person's body is positioned on this surface with his or her neck over the saddle-shaped neck support. As the person's neck comes into contact with the neck support, the weight of the person's head and/or neck pushes down on the neck support. The support structure is designed so that the neck support does not move directly downward, but instead moves down and away from the person's shoulders. This provides a gentle tension to the person's neck and the base of the head. The neck support is angled slightly downward toward the person's head to allow the head to tilt back. This helps to straighten the person's airway, as well as facilitating application of tension to the neck.

Another embodiment comprises a method for positioning the head and neck and applying tension to the head and neck. The method includes positioning a support device on a surface, where the support device is designed to move laterally, as well as downward when a downward force is applied to it. A person is then positioned on the surface, with his or her neck over the support device. The person's neck is then rested on the support device. The weight of the person's head and/or neck on the support device causes a portion of the support which is in contact with the person's neck to move slightly downward and laterally, away from the person's shoulders. Tension is thereby applied to the person's head and neck.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
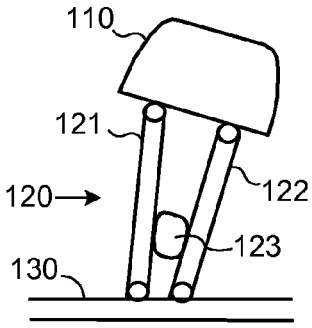
FIGS. 1-3 are diagrams illustrating the structure of a first exemplary embodiment of the invention.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

Figure 2:
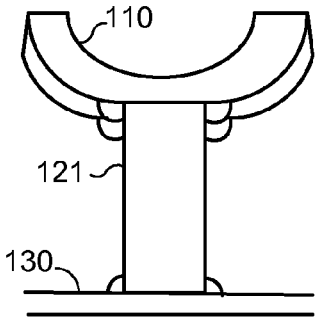

Referring to FIGS. 1-2, a first exemplary embodiment of the invention is illustrated. In this embodiment, a neck support 110 is connected to a support structure 120, which is in turn connected to a surface 130. Neck support 110 is saddle-shaped (or U-shaped). This provides several benefits. First, the shape makes the support more comfortable than a flat support (since the contact between the support and the neck is more distributed than in the case of a flat support). Additionally, the upward curve on the sides of the support prevents the neck from rolling to one side or the other as the person's head turns, which could potentially allow the neck to come off the support. Padding is provided on the upper side of the support (on the inside of the "U") to increase the comfort of the support and to make the position of the neck more stable.

Support structure 120 consists, in this embodiment, of two plates (121, 122) that are connected between neck support 110 and surface 130. Each of these plates is pivotally connected to neck support 110 and surface 130. Each plate is also spring loaded so that when no weight is placed on the neck support, the plates and neck support assume a first position (shown in FIGS. 1 and 2). When weight is placed on the neck support, the plates pivot toward a second position in which the neck support moves downward and laterally (to the right in FIG. 1). In this embodiment, an elastic bushing 123 is positioned between plates 121 and 122 to provide the spring loading.

In an alternative embodiment, only one of the plates may be spring loaded. The plates may be spring loaded at their upper or lower ends. The spring loading may employ any suitable type of spring mechanism, including conventional metal springs, elastic bands, flexible (e.g., elastomer) components, etc. The spring loading may be fixed, or it may be adjustable (which may allow it to provide varying amounts of tension, or to be used with persons of different weights). In another alternative embodiment, the device may not use spring loading at all, and may instead be manually raised to the first position before placing a person's neck on the neck support, which would then move downward and laterally.

Surface 130 provides a pivot point for plates 121 and 122. Surface 130 may consist of a simple, small base for the device, or it may be a larger surface, such as a back board or the surface of a gurney or stretcher on which a person may lie. In the case of a smaller base, it may be desirable to provide means to prevent the base from moving with respect to the surface on which a person lies, so that the lateral movement of the neck support will provide tension on the neck, rather than simply moving downward (if the base slides away from the person's head). This may be achieved, for example, through the use of a non-skid surface on the bottom of the base, an attachment mechanism, or other means to prevent movement of the base.

Figure 3:
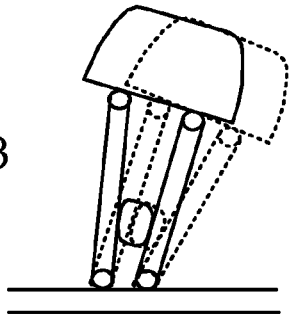

FIG. 3 is a diagram illustrating the movement of the device depicted in FIGS. 1 and 2. The first, raised position is shown using solid lines. The second, lowered position is shown using dotted lines. As explained above, when there is no weight on the neck support, the device is urged by spring loading toward the first position. When weight is placed on the neck support (e.g., when a person lies down with his or her neck on the neck support), the device moves toward the second, lowered position.

Figure 4:
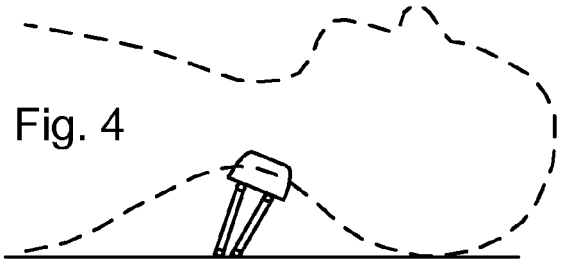
FIG. 4 is a diagram illustrating the use of the first exemplary embodiment by a person to support and apply tension to the person's neck.

FIG. 4 is a diagram illustrating the position of the device shown in FIGS. 1-3 with respect to person whose head and/or neck are supported by the device. This positioning is exemplary, and the positioning of the device with respect to the body may be adjusted as necessary to provide the desired support and/or tension. In this figure, the person's silhouette is depicted using dotted lines, while the device is shown using solid lines. It can be seen that the saddle-shaped neck support is positioned under the neck at the base of the skull. The downward and lateral (to the right) movement of the neck support places some tension on the head and neck, away from the person's torso. The uneven length of the plates in the support structure may, in some embodiments, be designed to cause the neck support to tilt back (rotate clockwise in the figure) slightly as it moves downward and laterally, thereby tilting the person's head back slightly. This may be desirable to straighten the person's airway, thereby making it easier for the person to breathe, or facilitating insertion of a breathing tube in an emergency situation. The support structure may alternatively be designed to maintain the same degree of tilt throughout the range of motion of the neck support, or it may be designed to reduce the degree of tilt as the neck support moves downward.

Figure 5:
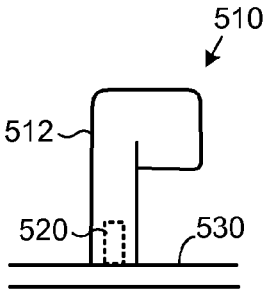
FIGS. 5-7 are diagrams illustrating the structure of a second exemplary embodiment of the invention.
Figure 6:
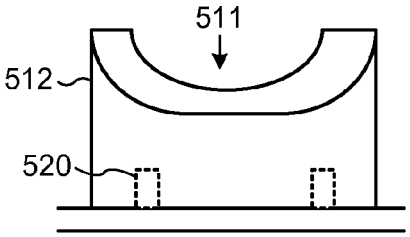
Figure 7:
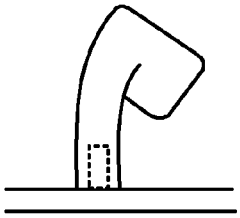

An alternative embodiment is illustrated in FIGS. 5 and 6. In this figure, the device consists of a flexible, one-piece neck support 510, which is placed over a vertical pin 520 that extends upward from surface 530. Pin 520 serves to maintain the position of the lower end of neck support 510 with respect to surface 530. When no weight is placed on neck support 520, the neck support has an upright orientation as shown in FIG. 5. When weight is placed on the saddle portion 511 of neck support 510, a vertical support portion 512 of the neck support bends (as shown in FIG. 7), providing downward and lateral movement of saddle portion 511 which is similar to the movement described above. Neck support 510 is made of an elastomeric material such as rubber, so that it can flex. The specific material properties and shape of neck support 510 determine the particular manner in which it flexes, and can be configured to provide a desired amount of movement, tilting and tension. These characteristics may also be affected by the specific configuration (e.g., length, diameter, material) of pin (or pins) 520. Surface 530 may again be a small base or a larger platform which supports the person's body, as well as the neck support device.

Another alternative embodiment may consist of a method. For instance, one method may include providing a movable head/neck support, positioning a person's head and/or neck above the support, and moving the person's head downward and away from his or her torso to provide a desired amount of tension to the head and neck, while at the same time tilting the head backward slightly to straighten the person's airway. This method may be performed for medical reasons (e.g., stabilizing and properly positioning the person on a gurney in preparation for medical treatment), or for therapeutic reasons (e.g., providing proper orientation of the head and neck and providing tension on the head and neck to relieve neck pain).

Figure 8:
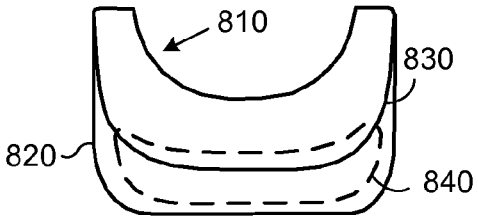
FIGS. 8-10 are diagrams illustrating the structure of a third exemplary embodiment of the invention.
Figure 9:
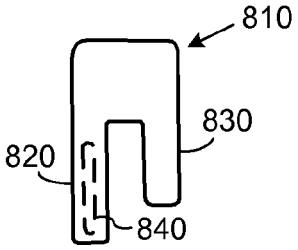
Figure 10:
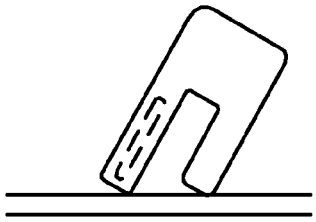

Another alternative embodiment may consist of a more portable device that is not attached to a base or surface as shown and described above. In this embodiment, illustrated in FIGS. 8 and 9, a neck support device is formed from an elastomeric material such as rubber. The device has a saddle portion 810 which directly supports the neck, as well as two support portions 820 and 830 which extend downward from the saddle portion. A first one of the support portions (820) is longer than the other (830). This causes the device to rest at an angle when placed on a surface such as a floor or a treatment table (see FIG. 10). When a person's neck is rested on the neck support, support portions 820 and 830 flex with respect to saddle portion 810, causing the saddle portion to move downward and laterally (to the right in FIG. 10), similar to the movement of the devices described above. In the embodiment of FIGS. 8-10, a stiffener plate 840 may be embedded in support portion 820 to prevent this portion of the device from flexing excessively and thereby preventing the desired movement of the device, which would prevent the desired positioning and tensioning of the head and neck.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A therapeutic device for supporting and applying tension to a person's head and neck comprising:

a support structure;

a neck support connected to an upper portion of the support structure;

wherein when a person's neck is rested on the neck support, the weight applied to the neck support causes the support structure to move in a direction which is away from the person's shoulders, thereby applying tension to the person's neck in the direction which is away from the person's shoulders;

wherein the support structure is connected to a support surface and is configured to pivot on the support surface; and wherein the support structure is spring loaded to urge the support structure toward a first position when no weight is placed on the neck support.

2. The device of claim 1, wherein when a person's neck is rested on the neck support, the weight applied to the neck support causes the neck support to rotate away from the person's shoulders.

3. The device of claim 1, wherein the neck support has a padded, saddle-shaped upper surface which supports the person's neck.

4. The device of claim 3, wherein the neck support is tilted in the direction which is away from the person's shoulders, so that a portion of the person's neck which is closer to the person's head is positioned lower than a portion of the person's neck which is closer to the person's shoulders.

5. The device of claim 1, wherein the neck support and support structure are formed as a single unit made of cast rubber, and wherein the weight applied to the neck support causes the support structure to bend, thereby applying tension to the person's neck.

6. A therapeutic device for supporting and applying tension to a person's head and neck comprising:

a support structure;

a neck support connected to an upper portion of the support structure;

wherein when the support structure is connected to a support surface and is configured to pivot on the support surface, wherein when no weight is placed on the neck support, the support structure and neck support assume a first, upright position;

wherein when a person's neck is rested on the neck support, the weight applied to the neck support causes the support structure to move from the first position toward a second position in a direction which is away from the person's shoulders, thereby applying tension to the person's neck in the direction which is away from the person's shoulders;

wherein when the weight of the person's neck is removed from the neck support, the support structure returns to the first position wherein the support structure is spring loaded to urge the support structure toward a first position when no weight is placed on the neck support.

* * * * *